US010147345B2

(12) United States Patent
Choi et al.

(10) Patent No.: US 10,147,345 B2
(45) Date of Patent: Dec. 4, 2018

(54) DISPLAY DEVICE, DATA PROCESSING APPARATUS AND METHOD FOR DRIVING THE SAME

(71) Applicant: Samsung Display Co., Ltd., Yongin-si, Gyeonggi-do (KR)

(72) Inventors: Sang-Hyun Choi, Yongin-si (KR); Young-Nam Yun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 227 days.

(21) Appl. No.: 15/179,866

(22) Filed: Jun. 10, 2016

(65) Prior Publication Data

US 2016/0284261 A1 Sep. 29, 2016

Related U.S. Application Data

(62) Division of application No. 13/717,334, filed on Dec. 17, 2012, now Pat. No. 9,378,704.

(30) Foreign Application Priority Data

Aug. 13, 2012 (KR) ..... 10-2012-0088593

(51) Int. Cl.
*G09G 5/02* (2006.01)
*G09G 3/20* (2006.01)
(Continued)

(52) U.S. Cl.
CPC ..... *G09G 3/2003* (2013.01); *G09G 3/3208* (2013.01); *G09G 3/3275* (2013.01);
(Continued)

(58) Field of Classification Search
CPC .. G09G 3/2003; G09G 3/3208; G09G 3/3275; G09G 5/02
See application file for complete search history.

(56) References Cited

U.S. PATENT DOCUMENTS

2006/0256292 A1* 11/2006 Lippey ..... G03B 21/26 353/29
2007/0188439 A1* 8/2007 Kimura ..... G09G 3/3406 345/102
(Continued)

FOREIGN PATENT DOCUMENTS

JP 2006-74691 A 3/2006
KR 10-2006-0053455 A 5/2006
(Continued)

*Primary Examiner* — Carolyn R Edwards
(74) *Attorney, Agent, or Firm* — Lewis Roca Rothgerber Christie LLP

(57) ABSTRACT

Provided is a display device including: a data processor controlling color reproducibility of RGB data under a low illumination environment to process an input image signal; a signal controller dividing the input image signal in a frame unit according to a vertical synchronization signal and the input image signal in a scan line unit according to a horizontal synchronization signal to generate an image data signal; and a data driver receiving the image data signal to transfer a plurality of data signals to each of the plurality of data lines coupled to a plurality of pixels. The display device reduces glaring and provides a higher-definition image to a user due to the accurate representation of neutral white under the high illumination environment.

15 Claims, 7 Drawing Sheets

(51) Int. Cl.
*G09G 3/3208* (2016.01)
*G09G 3/3275* (2016.01)
*G09G 5/10* (2006.01)

(52) U.S. Cl.
CPC ..... *G09G 5/02* (2013.01); *G09G 5/10* (2013.01); *G09G 2320/0626* (2013.01); *G09G 2320/0666* (2013.01); *G09G 2340/06* (2013.01); *G09G 2360/144* (2013.01)

(56) References Cited

U.S. PATENT DOCUMENTS

| | | | | |
|---|---|---|---|---|
| 2008/0170062 | A1 | 7/2008 | Ma | |
| 2013/0050165 | A1* | 2/2013 | Northway ..... | G09G 3/3466 345/207 |

FOREIGN PATENT DOCUMENTS

| | | | |
|---|---|---|---|
| KR | 10-2006-0118827 | | 11/2006 |
| KR | 10-2008-0051302 | A | 6/2008 |
| KR | 10-2008-0097515 | | 11/2008 |
| KR | 10-2009-0077184 | | 7/2009 |

* cited by examiner

DISPLAY DEVICE, DATA PROCESSING APPARATUS AND METHOD FOR DRIVING THE SAME

CROSS-REFERENCE TO RELATED APPLICATION

This application is a divisional of U.S. patent application Ser. No. 13/717,334, filed Dec. 17, 2012, which claims priority to and the benefit of Korean Patent Application No. 10-2012-0088593, filed Aug. 13, 2012, the entire content of both of which is incorporated herein by reference.

BACKGROUND

1. Field

Embodiments of the present invention relate to a display device, a data processing apparatus, and a method for driving the same, and more particularly, to a display device for providing a viewing environment according to an external illumination environment, a data processing apparatus, and a method for driving the same.

2. Description of the Related Art

A human eye has some adaptability to recognize colors from a reflector when an external illumination environment is changed. However, a display device does not have this adaptability, which needs to be compensated for.

A display device may include an illumination sensor to control luminance of the display device according to the external illumination environment. The illumination may be controlled to improve visibility of the display device for a user according to the external illumination environment, for example, the display device may increase luminance when the external illumination increases and may reduce luminance when the external illumination decreases.

However, controlling only the luminance according to the external illumination environment may not accurately reflect visual sensitivity characteristics of a user.

The above information disclosed in this Background section is only for enhancement of understanding of the background of the invention and therefore it may contain information that does not form the prior art that is already known in this country to a person of ordinary skill in the art.

SUMMARY

Aspects of the present invention provide a display device for accurately reflecting visual sensitivity characteristics of a user according to an external illumination environment, a data processing apparatus, and a method for driving the same.

An exemplary embodiment of the present invention provides a display device including: a data processor configured to control color reproducibility of RGB data according to external illumination to generate an input image signal; a signal controller configured to divide the input image signal in a frame unit according to a vertical synchronization signal and to divide the input image signal in a scan line unit according to a horizontal synchronization signal to generate an image data signal; and a data driver configured to receive the image data signal to transfer a plurality of data signals to a plurality of data lines coupled to a plurality of pixels.

The data processor may be configured to set a color target value according to the external illumination, and to control a color gamut according to the set color target value.

The data processor may be configured to set the color target value to reduce the color gamut as the external illumination is reduced.

The data processor may be configured to reduce the color gamut to reduce the color reproducibility and the brightness recognition according to the reduction in the color reproducibility.

According to an embodiment of the present invention, the data processor is configured to control the color reproducibility of the RGB data under a low illumination environment in which the external illumination is less than about 50 lux.

The data processor may be configured to control a color temperature to process the input image signal under a high illumination environment.

The data processor may be configured to calculate a color temperature of an external light source, and may be configured to match the color temperature of the display device with the color temperature of the external light source.

The high illumination environment may be an illumination environment in which the external illumination is at least about 5000 lux.

Another embodiment of the present invention provides a data processing apparatus, including: a data converter configured to convert first RGB data for displaying images in a display device into CIE tristimulus function data; a target value setting unit configured to set a color target value for controlling color reproducibility according to external illumination; and a color space converter configured to control a color gamut according to the color target value, and configured to convert the CIE tristimulus function data into second RGB data according to the controlled color gamut.

The target value setting unit may be configured to set the color target value to reduce the color gamut as the external illumination is reduced.

The target value setting unit may be configured to set the color target value for controlling the color reproducibility under a low illumination environment.

The low illumination environment, according to an embodiment of the present invention, is an illumination environment in which the external illumination is less than about 50 lux.

The data processing apparatus may further include an illumination sensor configured to measure the external illumination, and configured to transfer the measured external illumination to the target value setting unit.

The illumination sensor may include a color filter and may be configured to measure R, G, and B components of an external light source using the color filter.

The data processing apparatus may further include a color temperature calculator configured to calculate a color temperature of the external light source using the R, G, and B components of the external light source under a high illumination environment.

The high illumination environment may be an illumination environment in which the external illumination is at least about 5000 lux.

The color space converter may be configured to match the color temperature of the display device with the color temperature of the external light source, and may be configured to convert the CIE tristimulus function data into third RGB data.

Additionally, another embodiment of the present invention provides for a method for driving a data processing apparatus, including: measuring external illumination using an illumination sensor; controlling brightness recognition by controlling color reproducibility of RGB data for displaying images in a display device when the external illumination belongs to a low illumination environment; and controlling a color temperature of the display device to match a color temperature of an external light source when the external illumination belongs to a high illumination environment.

The controlling of the brightness recognition by controlling the color reproducibility of the RGB data for displaying images may include: setting a color target value according to the external illumination; and controlling a color gamut according to the set target value.

The setting of the color target value according to the external illumination may include: setting the color target value to reduce the color gamut as the external illumination is reduced.

The controlling of the brightness recognition by controlling the color reproducibility of the RGB data for displaying images may further include: converting first RGB data for displaying images into CIE tristimulus function data; and converting the CIE tristimulus function data into second RGB data by applying the color gamut defined according to the color target value.

The measuring of the external illumination using the illumination sensor may include measuring R, G, and B components of the external light source using a color filter included in the illumination sensor.

The controlling of the color temperature of the display device to match the color temperature of the external light source may further include calculating the color temperature of the external light source using the R, G, and B components of the external light source.

The controlling of the color temperature of the display device to match the color temperature of the external light source may further include: converting first RGB data for displaying images into CIE tristimulus function data; and converting the CIE tristimulus function data into third RGB data by applying the calculated color temperature of the external light source.

The method may further include: controlling luminance of the display device to luminance defined according to the external illumination when the external illumination belongs to a general illumination environment.

Comparing with the case in which only the luminance of the display device is controlled under the low illumination environment, embodiments of the present invention may reduce or prevent the glaring from occurring and may provide a higher-definition image to a user due to the accurate representation of neutral white under the high illumination environment.

DETAILED DESCRIPTION

Figure 1:
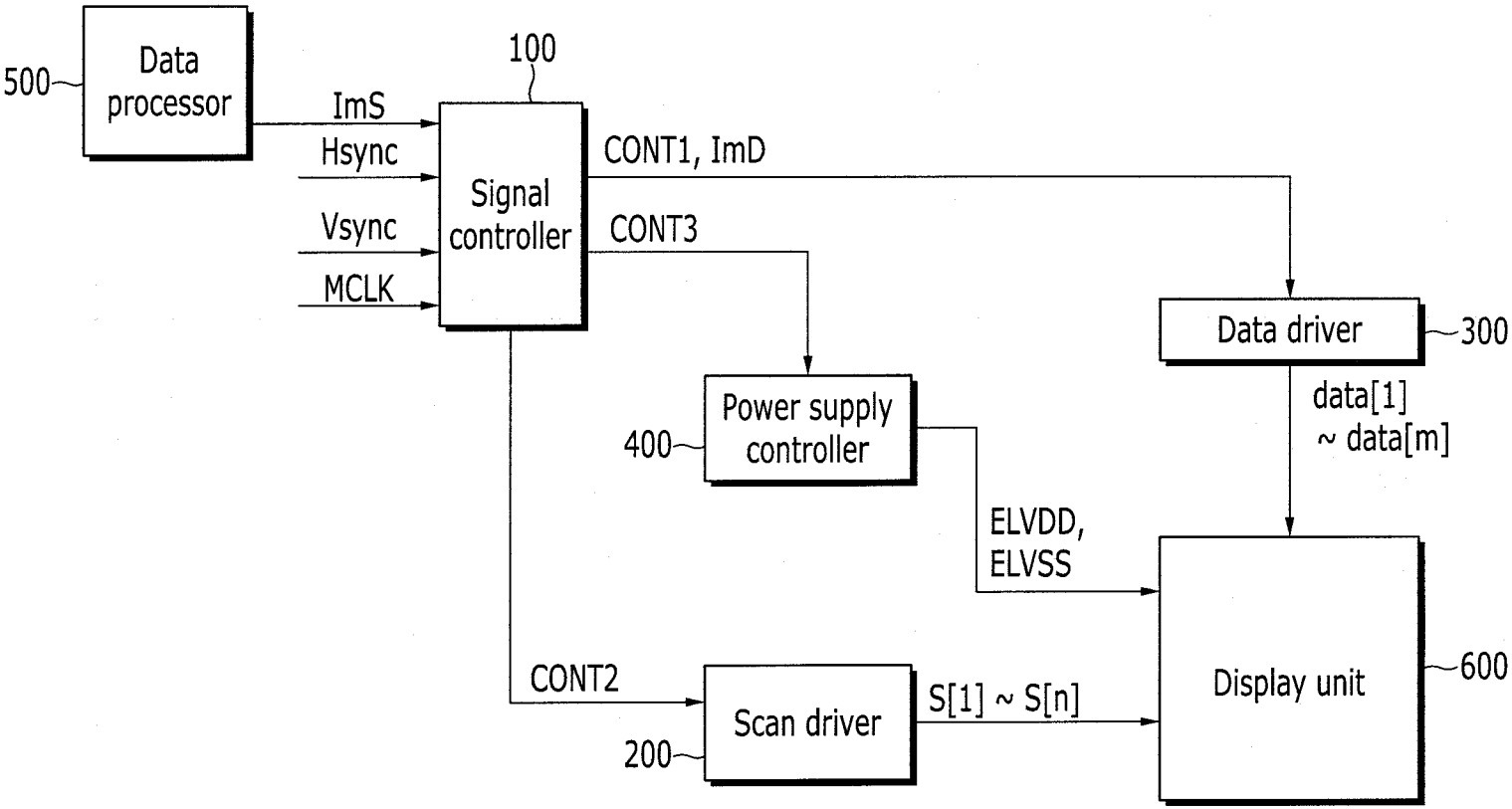
FIG. 1 is a block diagram illustrating a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive.

Further, in exemplary embodiments, since like reference numerals designate like elements having the same (or similar) configuration, a first exemplary embodiment is representatively described, and in other exemplary embodiments, only a configuration different from the first exemplary embodiment may be described.

Throughout this specification and the claims that follow, when it is described that an element is "coupled" (e.g., electrically coupled or connected) to another element, the element may be directly coupled to the other element or indirectly coupled to the other element through one or more intervening elements. Further, unless explicitly described to the contrary, the word "comprise" and variations such as "comprises" or "comprising", will be understood to imply the inclusion of the stated elements but not the exclusion of any other elements.

FIG. 1 is a block diagram illustrating a display device according to an exemplary embodiment of the present invention.

Referring to FIG. 1, a display device 10 includes a signal controller 100, a scan driver 200, a data driver 300, a power supply controller 400, a data processor 500, and a display unit 600.

The signal controller 100 receives an input image signal ImS and synchronization signals that may be input from an external device. The input image signal ImS may first be processed by a data processor 500 according to an external illumination environment, and may then be in turn input to the signal controller 100. The input image signal ImS includes luminance information of a plurality of pixels. The luminance may have a gray value that corresponds to a defined number, for example, $1024=2^{10}$, $256=2^{8}$, or $64=2^{6}$. The synchronization signals may include a horizontal synchronization signal Hsync, a vertical synchronization signal Vsync and a main clock signal MCLK.

In FIG. 1, the signal controller 100 generates first to third driving control signals CONT1, CONT2, and CONT3 and an image data signal ImD according to the input image signal ImS, the horizontal synchronization signal Hsync, the vertical synchronization signal Vsync, and the main clock signal MCLK.

The signal controller 100 may divide the input image signal ImS in a frame unit according to the vertical synchronization signal Vsync, and may divide the input image signal ImS in a scan line unit according to the horizontal synchronization signal Hsync to generate the image data signal ImD. The signal controller 100 transmits the image data signal ImD, together with the first driving control signal CONT1, to the data driver 300.

The display unit 600 is a display area including a plurality of pixels. The display unit 600 includes a plurality of scan lines extending in an approximate row direction so as to be approximately parallel with each other, a plurality of data lines extending in an approximate column direction so as to be approximately parallel with each other, and a plurality of power lines coupled to the plurality of pixels. The plurality of pixels are arranged in an approximate matrix form in an area in which a plurality of scan lines and a plurality of data lines cross each other.

The scan driver 200 is coupled to the plurality of scan lines and generates a plurality of scan signals S[1]-S[n] according to the second driving control signal CONT2. The scan driver 200 may sequentially apply the scan signals S[1] to S[n], which may be a gate on voltage, to the plurality of scan lines.

The data driver 300 is coupled to the plurality of data lines, and may sample and hold the image data signal ImD input according to the first driving control signal CONT1. The data driver 300 may transfer a plurality of data signals data[1] to data[m] to the plurality of data lines. The data driver 300 applies the data signals having a suitable (e.g., predetermined) voltage range to the plurality of data lines according to the scan signals S[1] to S[n].

The power supply controller 400 may determine a level of first power supply voltage ELVDD and second power supply voltage ELVSS according to the third driving control signal CONT3, which are in turn supplied to the power lines coupled to the plurality of pixels. The first power supply voltage ELVDD and the second power supply voltage ELVSS provide a driving current for a pixel.

The data processor 500 controls at least one of color reproducibility, luminance, or color temperature according to the external illumination environment to generate the input image signal ImS. For example, in an embodiment of the present invention, the data processor 500 controls the color reproducibility and the luminance under the low illumination environment, controls the luminance under the general illumination environment, and controls the color temperature and the luminance under the high illumination environment. The low illumination environment may be an illumination environment in which the external illumination is less than about 50 lux, the general illumination environment may be an illumination environment in which the external illumination is from about 50 lux to about 5000 lux, and the high illumination environment may be an environment in which the external illumination is at about 5000 lux or more.

Figure 2:
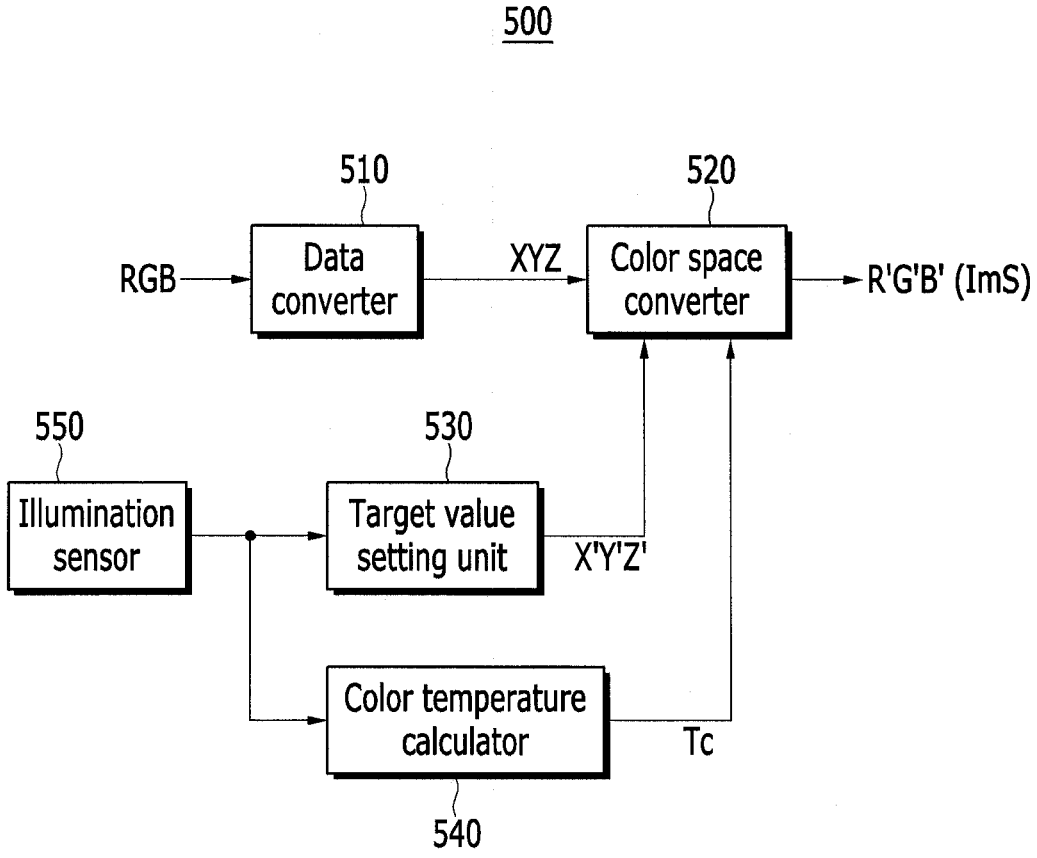
FIG. 2 is a block diagram illustrating a data processing apparatus according to an exemplary embodiment of the present invention.

FIG. 2 is a block diagram illustrating a data processing apparatus according to an exemplary embodiment of the present invention.

Referring to FIG. 2, the data processing apparatus 500 includes a data converter 510, a color space converter 520, a target value setting unit 530, a color temperature calculator 540, and an illumination sensor 550.

The data converter 510 converts analog RGB data (i.e., Red-Green-Blue data) for displaying images in the display device 10 into CIE tristimulus function XYZ data. Here, CIE is the International Commission on Illumination and tristimulus relates to values giving the amounts of three primary colored lights (e.g., XYZ) that when combined additively produce a match for the color being considered. For the CIE XYZ tristimulus color space model, "Y" means luminance, "Z" is quasi-equal to blue stimulation, or the S cone response, and "X" is a mix (a linear combination) of cone response curves chosen to be nonnegative.

The color space converter 520 converts the CIE tristimulus function XYZ data into R'G'B' data according to at least one of a color target value set by the target value setting unit 530 or the color temperature calculated by the color temperature calculator 540. The R'G'B' data may be input to the signal controller 100 of the display device 10 of FIG. 1 as the input image signal ImS.

The target value setting unit 530 sets color target values X'Y'Z' according to the external illumination measured by the illumination sensor 550. According to an embodiment of the present invention, the target value setting unit 530 sets the color target value so that a color gamut is reduced as the external illumination decreases (e.g., dims or becomes darker) in the low illumination environment (e.g., where the external illumination is less than about 50 lux). When the color gamut is reduced, the color reproducibility of the display device is reduced in turn. That is, the target value setting unit 530 may set the color target value for controlling the color reproducibility according to the external illumination.

The human eye is less sensitive to the low illumination environment than the general illumination environment in terms of the identification capability of color and contrast. The illumination range of about 0 lux to about 50 lux is an area in which a rod cell and a cone cell of a human are concurrently (e.g., simultaneously) activated. In this instance, the rod cell cannot recognize colors due to the reduced sensitivity to R, G, and B colors. That is, a difference in colors recognizable by a human eye is not large even when the color reproducibility is reduced under the low illumination environment.

Therefore, the target value setting unit 530 sets the color target value so that the color gamut is reduced as the external illumination is reduced under the low illumination environment. Accordingly, the brightness recognition by the user may be reduced without the user recognizing the difference in colors.

Table 1 shows a brightness recognition percentage and a contrast recognition ratio according to the color reproducibility (based on CIECAM02), according to an embodiment of the present invention. Table 1 shows results obtained by constantly setting a luminance condition of an AMOLED display to be 100 nit (1 nit=1 candela per square meter ($cd/m^2$)) and confirming the brightness difference according to the color reproducibility.

TABLE 1

| Color Reproducibility | sRGB | 100% | 87% | 70% | 53% |
|---|---|---|---|---|---|
| Brightness Recognition | 100% | 155.6% | 130.0% | 100.4% | 74.7% |
| Contrast Ratio Recognition | — | 11.38 | 11.38 | 11.39 | 11.28 |

In Table 1, the color reproducibility percentage is according to the National Television Systems Committee (NTSC) standard and the brightness recognition is according to the sRGB standard.

In the above example, it can be appreciated that, as the color reproducibility is reduced under the low illumination environment, the brightness recognition percentage is reduced, however, the contrast recognition ratio is substantially maintained at an equivalent level. When the color reproducibility is reduced to 53%, the brightness recognition is reduced by about ½, but the contrast recognition ratio is substantially maintained at an equivalent level, as compared with when the color reproducibility is 100%.

Under the bedroom environment in which the external illumination environment is less than about 10 lux, a cellular phone, TV, and the like, are frequently used, but the minimum luminance of the display device may be 10 nit or more, which may cause glaring for a user. As such, a method for controlling only the luminance of the display device may cause glaring under the low illumination environment.

However, according to an embodiment of the present invention, the brightness recognition by a user may be reduced with the reduced luminance and the color reproducibility under the low illumination environment, such that the glaring may also be reduced.

Figure 3:
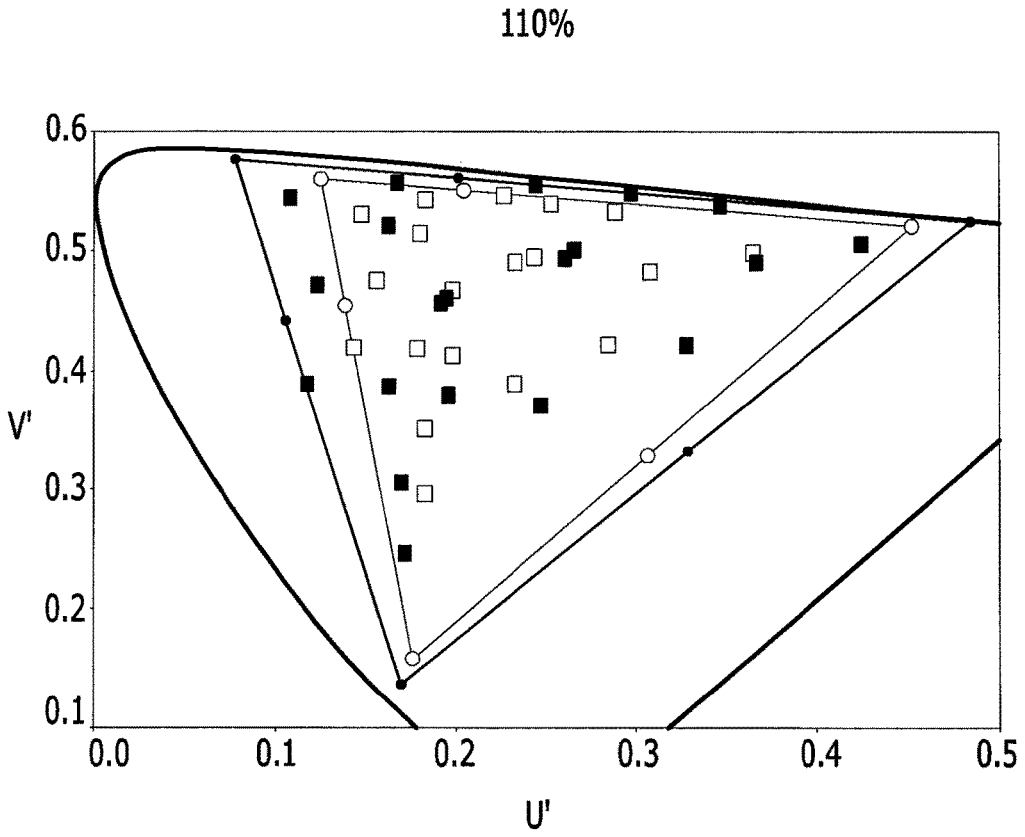
FIG. 3 is a graph illustrating a color gamut on the basis of a control of color reproducibility according to an exemplary embodiment of the present invention.
Figure 4:
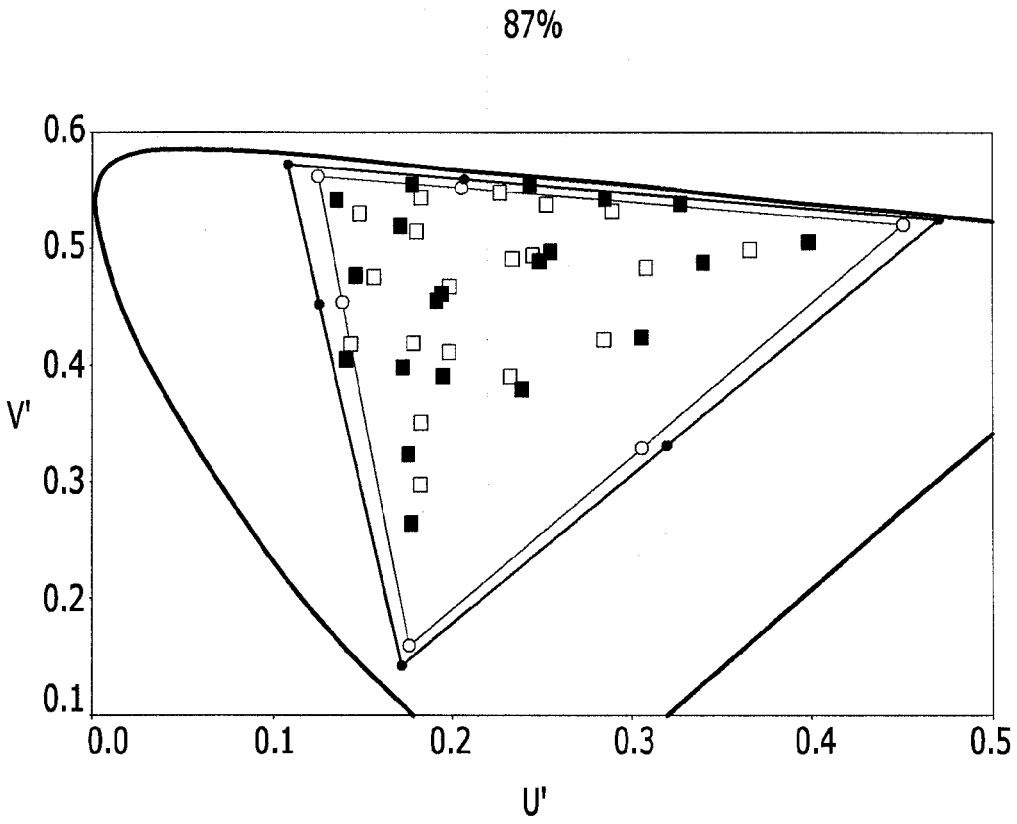
FIG. 4 is a graph illustrating a color gamut on the basis of a control of color reproducibility according to another exemplary embodiment of the present invention.
Figure 5:
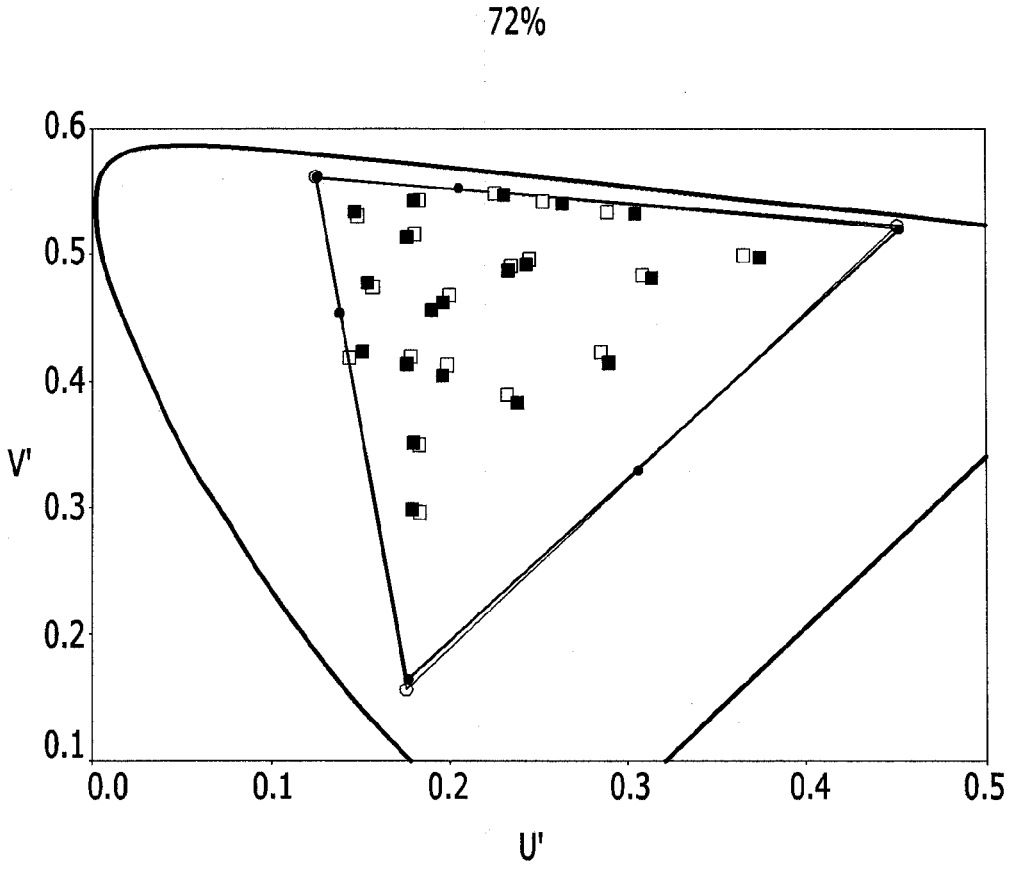
FIG. 5 is a graph illustrating a color gamut on the basis of a control of color reproducibility according to yet another exemplary embodiment of the present invention.
Figure 6:
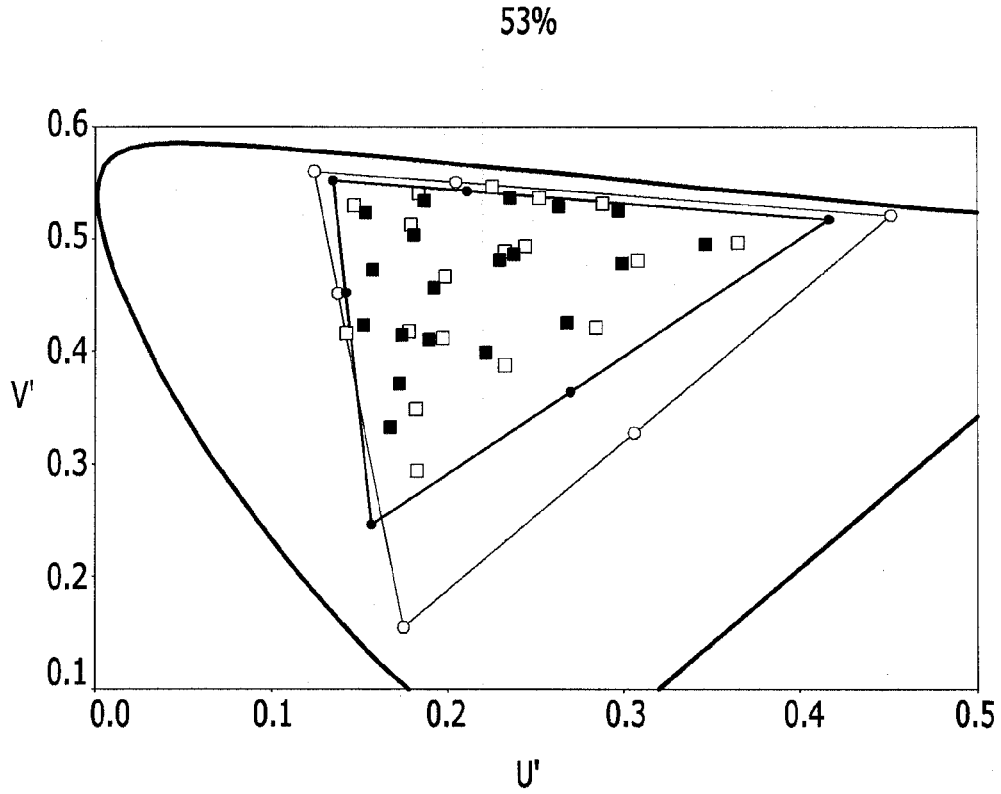
FIG. 6 is a graph illustrating a color gamut on the basis of a control of color reproducibility according to still another exemplary embodiment of the present invention.

FIGS. 3 to 6 are graphs illustrating a color gamut when the color target value is controlled so that the color reproducibility is 110%, 87%, 72%, and 53%, respectively, in a single OLED display device. FIG. 3 illustrates a color gamut when the color reproducibility is 110% and illustrates a sRGB standard color gamut. FIG. 4 illustrates a color gamut when the color reproducibility is 87% and illustrates the sRGB standard color gamut. FIG. 5 illustrates a color gamut when the color reproducibility is 72% and illustrates the sRGB standard color gamut. FIG. 6 illustrates a color gamut when the color reproducibility is 53% and illustrates the sRGB standard color gamut.

For FIGS. 3 to 6, RGBCMY and Gratag Macbeth values were measured by a CIE1976 colorimetric system. A color gamut connected to ○ (i.e., empty circles) is the sRGB standard color gamut, and □ (i.e., empty squares) represents data of the sRGB standard color gamut. A color gamut connected to ● (i.e., filled circles) is a color gamut controlled according to the color target value, and ■ (i.e., filled squares) represents data of the controlled color gamut.

According to an embodiment of the present invention, the color gamut when the color reproducibility is 110% includes the sRGB standard color gamut, and the color gamut when the color reproducibility is 87% includes the sRGB standard color gamut but is narrower than the color gamut when the color reproducibility is 110%. Also, the color gamut when the color reproducibility is 72% approximately coincides with the sRGB standard color gamut, and the color gamut when the color reproducibility is 53% is narrower than the sRGB standard color gamut. It can be appreciated that as the color gamut narrows, the interval between data may become proximate. The proximity of an interval between data means that a color difference may be reduced and the color reproducibility may be reduced. That is, it means that the color reproducibility can be reduced with the reduced color gamut.

Referring back to FIG. 2, the target value setting unit 530 may store (and/or determine) the color target value according to the external illumination, and when the external illumination value is transferred to the illumination sensor 550, the color target value corresponding to the external illumination value may be transferred to the color space converter 520. The target value setting unit 530 may transfer the color target value corresponding to the external illumination to the color space converter 520 under the low illumination environment in which the external illumination is less than about 50 lux.

The color space converter 520 controls the color gamut according to the color target value received under the low illumination environment, and converts the CIE tristimulus function XYZ data into R'G'B' data according to the controlled color gamut.

The illumination sensor 550 may be disposed outside or inside a display area and may sense, for example, the peripheral light source, to measure the external illumination. The illumination sensor 550 transfers the measured external illumination to the target value setting unit 530.

According to an embodiment of the present invention, the illumination sensor 550 may include at least three sensors, each of which may be provided with color filters. When the illumination sensor 550 includes three sensors, the first sensor may be provided with the color filter transmitting only an R component, the second sensor may be provided with the color filter transmitting only a G component, and the third sensor may be provided with a color filter transmitting only a B component. Therefore, the illumination sensor 550 may measure the R, G, and B components of an external light source using the color filters. Additionally, if the color filters do not cut off infrared rays and/or ultraviolet light, an infrared ray filter and/or an ultraviolet light filter may be additionally disposed at the three sensors. The illumination sensor 550 transfers the R, G, and B components of the measured external light source to the color temperature calculator 540.

According to an embodiment of the present invention, the color temperature calculator 540 calculates a color temperature Tc of the external light source according to the R, G, and B components of the external light source. The color temperature calculator 540 may calculate the color temperature Tc of the external light source when the external illumination is the high illumination environment. The color temperature Tc representing a color of light emitted from a light source corresponds to a temperature of a block body that has the same color as the color of the light.

The spectral characteristics of the color filter mounted in the illumination sensor 550 may be equal to the tristimulus function established in the CIE. However, the spectral characteristics of the color filter may not actually coincide with the CIE tristimulus function.

Therefore, the color temperature calculator 540 may correct the R, G, and B components received from the illumination sensor 550 with the CIE tristimulus function using a matrix.

Equation 1 shows an example of an Equation that corrects the measured R, G, and B components with the CIE tristimulus function.

$$\{R,G,B\}_s=\{R,G,B\}_c \cdot A$$

$$A=(\{R,G,B\}_c^T \cdot \{R,G,B\}_c)^{-1} \cdot (\{R,G,B\}_c^T \cdot \{R,G,B\}_s) \quad \text{[Equation 1]}$$

In Equation 1, $\{R, G, B\}_s$ represents an output value of the illumination sensor 550, $\{R,G,B\}_c$ represents the CIE tristimulus function, and A represents a 3×3 conversion matrix. According to an embodiment of the present invention, the R, G, and B components of the external light source measured by the illumination sensor 550 are represented by the CIE tristimulus function XYZ, based on Equation 1.

The color temperature calculator 540 converts the CIE tristimulus function XYZ into an xy color coordinate and a color temperature.

Equation 2 represents an example of an Equation that converts the CIE tristimulus function XYZ into the xy color coordinate and the color temperature.

$$x = \frac{X}{X+Y+Z},\ y = \frac{Y}{X+Y+Z} \quad \text{[Equation 2]}$$

$$Tc(CCT) = -449n^3 + 3525n^2 - 6823.3n + 5520.33$$

$$n = (x - xe)/(y - ye)(x_e = 0.3320,\ y_e = 0.1858)$$

In Equation 2, the xy color coordinate represents a value of the CIE1931 colorimetric system, and the color temperature represents a correlated color temperature Tc.

The color temperature calculator 540 transfers the calculated color temperature Tc to the color space converter 520.

The calculated color temperature Tc means the color temperature of the external light source.

The color space converter 520 matches the color temperature of the display device with the calculated color temperature Tc, that is, the color temperature of the external light source. According to an embodiment of the present invention, the color temperature of the display device may match the color temperature of the external light source by matching the neutral white of the display device with the color temperature of the external light source based on a chromatic adaptation theory. The color space converter 520 may match coordinates of the neutral white of the display device with the color temperature of the external light sources as closely as possible. Further, the color space converter 520 may match the color temperature of the display device with the color temperature of the external light source and then, may convert the CIE tristimulus function XYZ data received from the data converter 510 into the R'G'B' data.

The color space converter 520 may control the color reproducibility under the low illumination environment or may also control the luminance during the process of controlling the color temperature under the high illumination environment. Further, the color space converter 520 may also control only the luminance under the general illumination environment.

Figure 7:
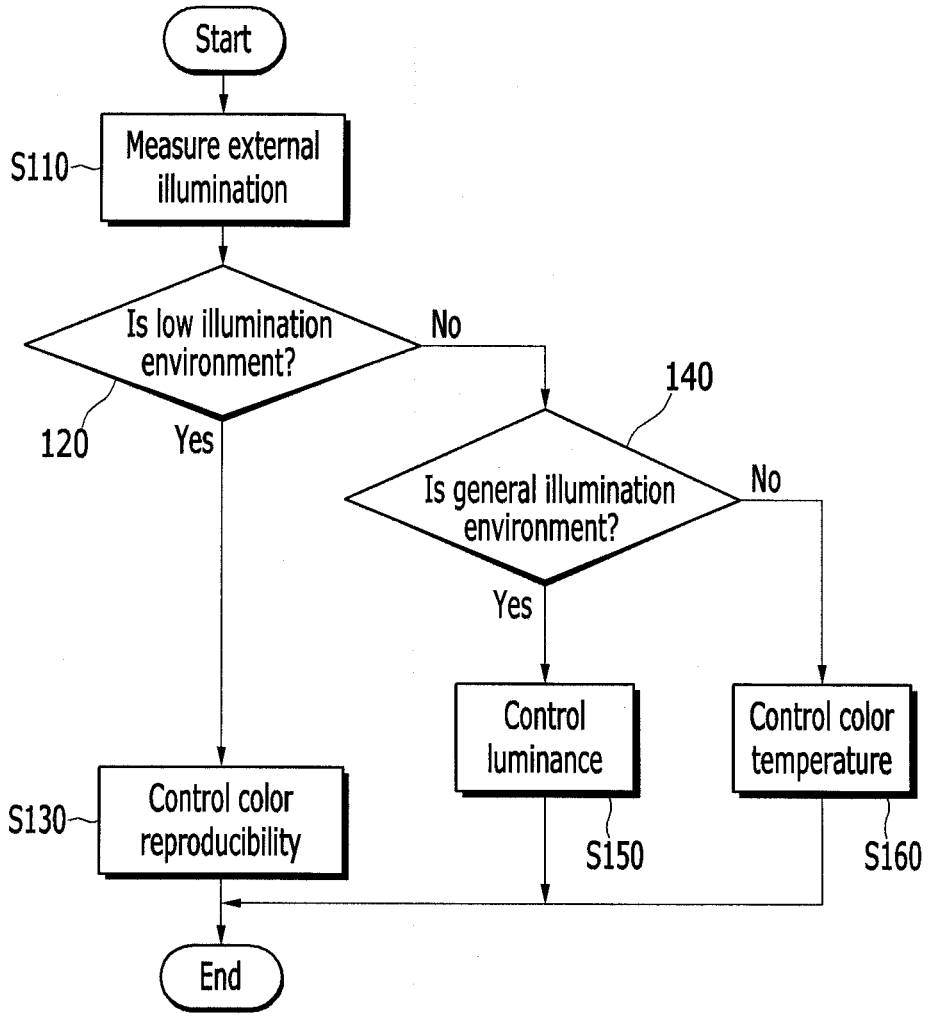
FIG. 7 is a flow chart illustrating a method for driving a data processing apparatus according to an exemplary embodiment of the present invention.

FIG. 7 is a flow chart illustrating a method for driving a data processing apparatus according to an exemplary embodiment of the present invention.

Referring to FIG. 7, the data processing apparatus 500 measures the external illumination using the illumination sensor 550 (S110). The illumination sensor 550 may measure the R, G, and B components of the external light source using the color filters.

The data processing apparatus 500 determines whether or not the external illumination belongs to the low illumination environment (S120). The low illumination environment may be the illumination environment in which the external illumination is less than about 50 lux.

When the external illumination belongs to the low illumination environment, the data processing apparatus 500 controls the color reproducibility of the RGB data for displaying images (S130). The data processing apparatus 500 sets the color target value X'Y'Z' that determines the color gamut according to the external illumination under the low illumination environment. The color target value is set to reduce the color gamut as the external illumination is reduced. When the color gamut is reduced, the color reproducibility of the display device is also reduced. Even though the color reproducibility is reduced under the low illumination environment, the user may not recognize the difference in colors, but may recognize that the brightness of the display device is reduced. That is, according to an embodiment of the present invention, the brightness recognition of the display device is controlled by adjusting the color reproducibility of the RGB data for displaying images under the low illumination environment.

The data processing apparatus 500 may convert the RGB data for displaying images into the CIE tristimulus function XYZ data, and may apply the color gamut defined according to the color target value X'Y'Z' to convert the CIE tristimulus function XYZ data into the R'G'B' data.

The data processing apparatus 500 may also control the luminance together with the color reproducibility of the RGB data under the low illumination environment.

When the external illumination does not belong to the low illumination environment, the data processing apparatus 500 determines whether or not the external illumination belongs to the general illumination environment (S140). The general illumination environment may be the illumination environment in which the external illumination is from about 50 to about 5000 lux.

When the external illumination belongs to the general illumination environment, the data processing apparatus 500 controls the luminance of the RGB data for displaying images to the luminance defined according to the external illumination (S150). That is, the data processing apparatus 500 may convert and output the luminance value of the RGB data for displaying images based on the luminance defined according to the external illumination.

When the external illumination does not belong to the general illumination environment or the low illumination environment (i.e., the external illumination belongs to the high illumination environment), the data processing apparatus 500 controls the color temperature of the display device (S160). The high illumination environment may be the environment in which the external illumination is about 5000 lux or more. The data processing apparatus 500 corrects the R, G, and B components of the external light source measured by the illumination sensor 550 with the CIE tristimulus function, and converts the corrected CIE tristimulus function into the xy color coordinate and the color temperature. Further, the data processing apparatus 500 matches the color temperature of the display device with the color temperature of the external light source.

The data processing apparatus 500 converts the RGB data for displaying images into the CIE tristimulus function XYZ data, and applies the color temperature matched with the color temperature of the external light source to convert the CIE tristimulus function XYZ data into R'G'G' data.

The drawings and the detailed description of the present invention shown and described herein are only examples of the present invention. These examples are provided to describe the present invention, and should not be used to limit the scope of the present invention that is recited in the following claims. Therefore, it will be appreciated by those skilled in the art that various modifications and equivalent arrangements are included within the spirit and scope of the present invention. Accordingly, the scope of the present invention must be determined by the appended claims and their equivalents.

DESCRIPTION OF SOME REFERENCE NUMERALS

500: Data processing apparatus
510: Data converter
520: Color space converter
530: Target value setting unit
540: Color temperature calculator
550: Illumination sensor

What is claimed is:

1. A data processing apparatus, comprising:

a data converter configured to convert first RGB data for displaying images in a display device into CIE tristimulus function data;

a target value setting unit configured to set a color target value for controlling color reproducibility according to external illumination; and a color space converter configured to control a color gamut according to the color target value, and configured to convert the CIE tristimulus function data into second RGB data according to the controlled color gamut, wherein the data processing apparatus is configured to set a color target value to reduce the color gamut as the external illumination is reduced and generate a first input image signal according to the controlled color gamut when the external illumination is below a predetermined threshold level, and the data processing apparatus is configured to calculate a color temperature of the external illumination, match the color temperature of a display device with the color temperature of the external illumination, and generate a second image signal according to the matched color temperature when the external illumination is more than the predetermined threshold level.

2. The data processing apparatus of claim 1, wherein:

the target value setting unit is configured to set the color target value to reduce the color gamut as the external illumination is reduced.

3. The data processing apparatus of claim 1, wherein:

the target value setting unit is configured to set the color target value for controlling the color reproducibility under a low illumination environment.

4. The data processing apparatus of claim 3, wherein:

the low illumination environment is an illumination environment in which the external illumination is less than about 50 lux.

5. The data processing apparatus of claim 1, further comprising:

an illumination sensor configured to measure the external illumination, and configured to transfer the measured external illumination to the target value setting unit.

6. The data processing apparatus of claim 5, wherein:

the illumination sensor comprises a color filter and is configured to measure R, G, and B components of an external light source using the color filter.

7. The data processing apparatus of claim 6, further comprising:

a color temperature calculator configured to calculate a color temperature of the external light source using the R, G, and B components of the external light source under a high illumination environment.

8. The data processing apparatus of claim 7, wherein:

the high illumination environment is an illumination environment in which the external illumination is at least about 5000 lux.

9. The data processing apparatus of claim 6, wherein:

the color space converter is configured to match the color temperature of the display device with the color temperature of the external light source, and is configured to convert the CIE tristimulus function data into third RGB data.

10. A method for driving a data processing apparatus, comprising:

measuring external illumination using an illumination sensor;

when the external illumination is below a predetermined threshold level, setting a color target value to reduce a color gamut as the external illumination is reduced, controlling the color gamut according to the set color target value, and generating a first input image signal according to the controlled color gamut; and when the external illumination is more than the predetermined threshold level, calculating a color temperature of the external illumination, matching the color temperature of the display device with the color temperature of the external illumination, and generating a second image signal according to the matched color temperature.

11. The method of claim 10, further comprising:

converting first RGB data for displaying images into CIE tristimulus function data; and converting the CIE tristimulus function data into second RGB data by applying the color gamut defined according to the color target value.

12. The method of claim 10, wherein:

the measuring of the external illumination using the illumination sensor comprises:

measuring R, G, and B components of an external light source using a color filter included in the illumination sensor.

13. The method of claim 12, wherein:

the color temperature of the external light source is calculated using the R, G, and B components of the external light source.

14. The method of claim 13, further comprising:

converting first RGB data for displaying images into CIE tristimulus function data; and converting the CIE tristimulus function data into third RGB data by applying the calculated color temperature of the external light source.

15. The method of claim 10, further comprising:

controlling luminance of the display device to luminance defined according to the external illumination when the external illumination belongs to a general illumination environment.

* * * * *